US007654879B2

(12) United States Patent
Dunham

(10) Patent No.: US 7,654,879 B2
(45) **Date of Patent: *Feb. 2, 2010**

(54) JUMPING TOY WITH DISASSEMBLY ACTION

(75) Inventor: Steve Dunham, Venice, CA (US)

(73) Assignee: Mattel, Inc., El Segundo, CA (US)

( * ) Notice: Subject to any disclaimer, the term of this patent is extended or adjusted under 35 U.S.C. 154(b) by 162 days.

This patent is subject to a terminal disclaimer.

(21) Appl. No.: 11/418,682

(22) Filed: May 4, 2006

(65) Prior Publication Data

US 2007/0259591 A1 Nov. 8, 2007

(51) Int. Cl.
*A63H 17/02* (2006.01)
*A63H 17/26* (2006.01)

(52) U.S. Cl. ..... 446/6; 446/466; 446/470

(58) Field of Classification Search ..... 446/6, 446/431, 435, 437, 456, 462, 465, 466, 470, 446/471

See application file for complete search history.

(56) References Cited

U.S. PATENT DOCUMENTS

| | | | | |
|---|---|---|---|---|
| 2,385,724 | A | 9/1945 | Olson | |
| 2,597,094 | A | 5/1952 | Gutmann | |
| 2,757,482 | A | 8/1956 | Brown et al. | |
| 2,803,920 | A | 8/1957 | Salosky | |
| 3,000,137 | A * | 9/1961 | Vine | 446/6 |
| 3,037,772 | A | 6/1962 | Bonanno | |
| 3,176,429 | A | 4/1965 | Brown et al. | |
| 3,695,148 | A | 10/1972 | Baginski et al. | |
| 3,959,920 | A | 6/1976 | Ieda | |
| 4,466,214 | A | 8/1984 | Kulesza et al. | |
| 4,490,124 | A | 12/1984 | Ogawa | |
| 4,571,197 | A | 2/1986 | Kulesza et al. | |
| 4,583,957 | A | 4/1986 | Levy | |
| 4,702,720 | A | 10/1987 | Konta et al. | |
| 4,850,929 | A | 7/1989 | Genevey | |
| 4,911,669 | A | 3/1990 | Parker | |
| 5,092,808 | A * | 3/1992 | Takasaka et al. | 446/178 |
| 5,131,880 | A | 7/1992 | Nesbit et al. | |
| 5,322,469 | A | 6/1994 | Tilbor | |
| 5,380,231 | A | 1/1995 | Brovelli | |
| 5,381,778 | A | 1/1995 | D'Andrade et al. | |
| 5,618,219 | A * | 4/1997 | Simone et al. | 446/456 |

(Continued)

FOREIGN PATENT DOCUMENTS

| | | | |
|---|---|---|---|
| JP | 07163761 | A | 6/1995 |

(Continued)

*Primary Examiner*—John Ricci
(74) *Attorney, Agent, or Firm*—Edell, Shapiro & Finnan LLC

(57) ABSTRACT

A toy vehicle. The toy vehicle includes a base, a plurality of wheels spinably connected to the base, and a pneumatic piston operatively connected to at least one of the wheels. The toy also includes a plurality of body pieces at least partially covering the base, and a pneumatic disassembly mechanism operatively connected to at least some of the plurality of body pieces. A pneumatic system is configured to deliver pressurized gas to the pneumatic piston to cause at least the base to jump by extending the at least one wheel away from the base. The pneumatic system is also configured to deliver pressurized gas to the pneumatic disassembly mechanism to separate at least some of the plurality of body pieces from the base.

22 Claims, 8 Drawing Sheets

U.S. PATENT DOCUMENTS

| | | | | |
|---|---|---|---|---|
| 5,722,872 | A * | 3/1998 | Simmons et al. | 446/456 |
| 5,785,576 | A | 7/1998 | Belton | |
| 5,906,528 | A | 5/1999 | Ostendorff et al. | |
| 6,015,330 | A | 1/2000 | Simmons et al. | |
| 6,036,575 | A | 3/2000 | Rehkemper et al. | |
| 6,227,934 | B1 | 5/2001 | Isaksson et al. | |
| 6,321,737 | B1 | 11/2001 | Johnson et al. | |
| 6,322,417 | B1 | 11/2001 | Bass | |
| 6,383,054 | B1 | 5/2002 | Rauch | |
| 6,394,877 | B1 | 5/2002 | Venditti | |
| 6,398,613 | B1 * | 6/2002 | Rehkemper et al. | 446/197 |
| 6,565,412 | B1 | 5/2003 | Thrasher | |
| 6,568,984 | B1 | 5/2003 | Applewhite | |
| 6,620,023 | B2 | 9/2003 | Yeung | |
| 6,758,719 | B1 | 7/2004 | Nava | |
| 6,764,376 | B2 | 7/2004 | Agostini et al. | |
| 6,767,272 | B2 * | 7/2004 | Santarsiero | 446/466 |
| 7,077,359 | B2 | 7/2006 | Poesch et al. | |
| 7,160,171 | B1 | 1/2007 | Rehkemper et al. | |
| 2002/0077026 | A1 | 6/2002 | Li | |
| 2005/0266769 | A1 | 12/2005 | Edwards | |

FOREIGN PATENT DOCUMENTS

| | | |
|---|---|---|
| WO | WO 2004/105908 | 5/2004 |

* cited by examiner

JUMPING TOY WITH DISASSEMBLY ACTION

BACKGROUND

Children enjoy playing with toys for a variety of reasons. In general, children enjoy playing with toys because they can use their imagination to create make-believe scenarios in which they cannot participate in real life. Children also can enjoy the challenges involved with learning how to operate new toys and discovering how these toys work. Therefore, a child may be more inclined to play with toys that can be adaptable or can perform a variety of different play experiences that can energize the child's imagination. Furthermore, a toy capable of such variety can attract the initial interest of a child and may keep a child's attention longer.

SUMMARY

A toy vehicle includes a base, a plurality of wheels spinably connected to the base, and a pneumatic piston operatively connected to at least one of the wheels. The toy also includes a plurality of body pieces at least partially covering the base, and a pneumatic disassembly mechanism operatively connected to at least some of the plurality of body pieces. A pneumatic system is configured to deliver pressurized gas to the pneumatic piston to cause at least the base to jump by extending the at least one wheel away from the base. The pneumatic system is also configured to deliver pressurized gas to the pneumatic disassembly mechanism to separate at least some of the plurality of body pieces from the base.

WRITTEN DESCRIPTION

The present disclosure is directed to various features that can add play value to a variety of different toys. For the purpose of simplicity, each of the various features is described in the context of a toy monster-truck vehicle, although the features are equally applicable to a variety of different types of toys. Furthermore, while the described and illustrated monster-truck vehicle includes each of the disclosed features, it should be understood that the disclosed features are believed to be independently patentable, and a single toy need not include all such features.

Figure 1:
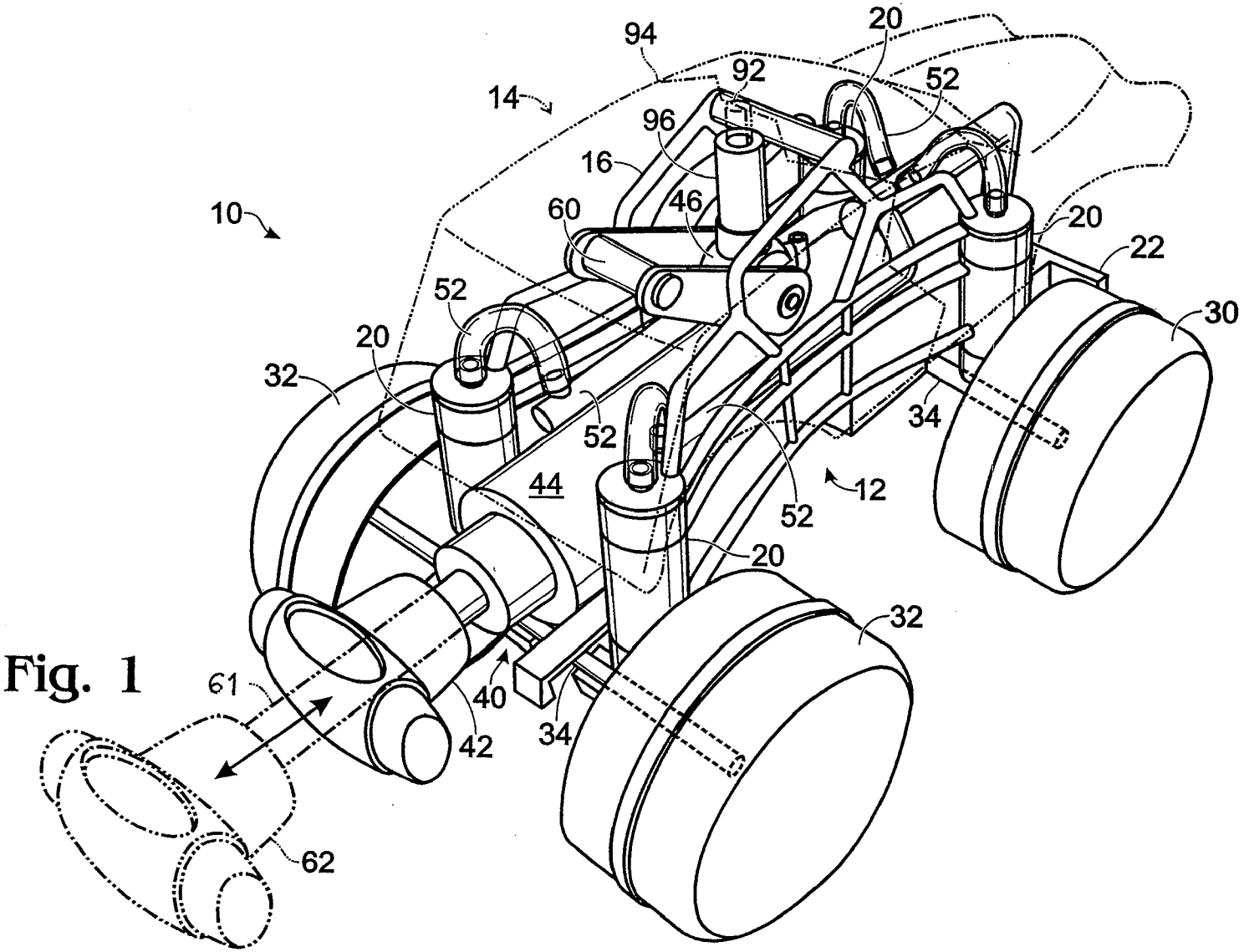
FIG. 1 shows an exemplary toy according to an embodiment of the present disclosure.

FIG. 1 shows a rear perspective view of an exemplary toy 10, in the form of an off-road vehicle, sometimes referred to as a monster truck. In some embodiments, a toy incorporating one or more of the herein described features can be configured to visually simulate the appearance of a different monster truck or a different type of off-road vehicle. For example, the body shell may simulate a panel truck, pickup truck, dune buggy, sport utility vehicle, tank etc. Furthermore, the wheels may be configured to simulate "off road" tires with large treads. Although the illustrated embodiment shows a toy with four wheels, it should be appreciated that in some embodiments the toy may include more or less wheels. Furthermore, other non-vehicle toy forms are also within the scope of this disclosure. For example, a toy can be made to simulate realistic or fantastical animals or monsters. Instead of wheels, such a toy may include legs; instead of a vehicle body panel, such a toy may include a skin covering, scales, or a shell.

Figure 2:
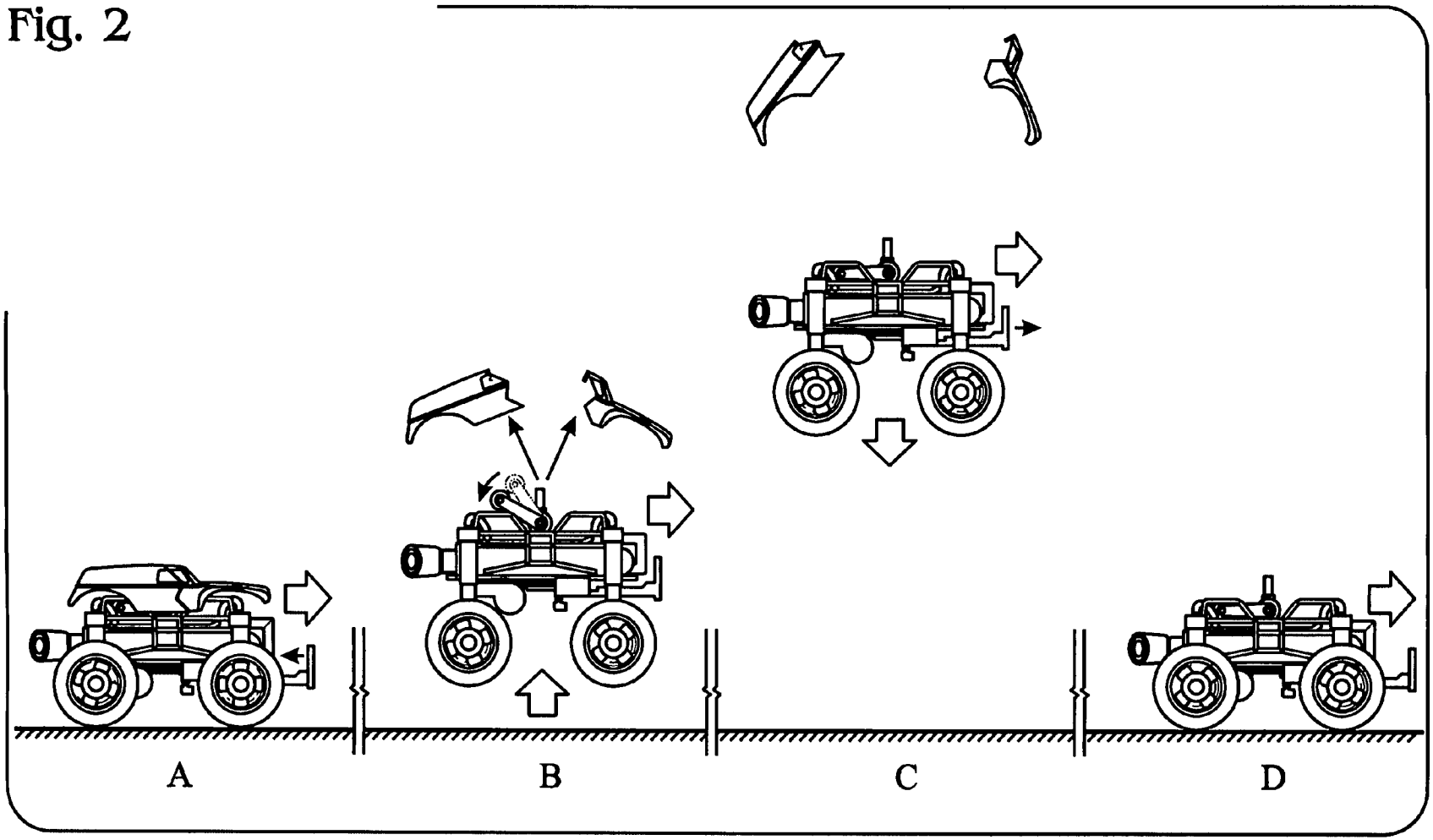
FIG. 2 shows the toy of FIG. 1 performing a jump action and a disassembly action.
Figure 3:
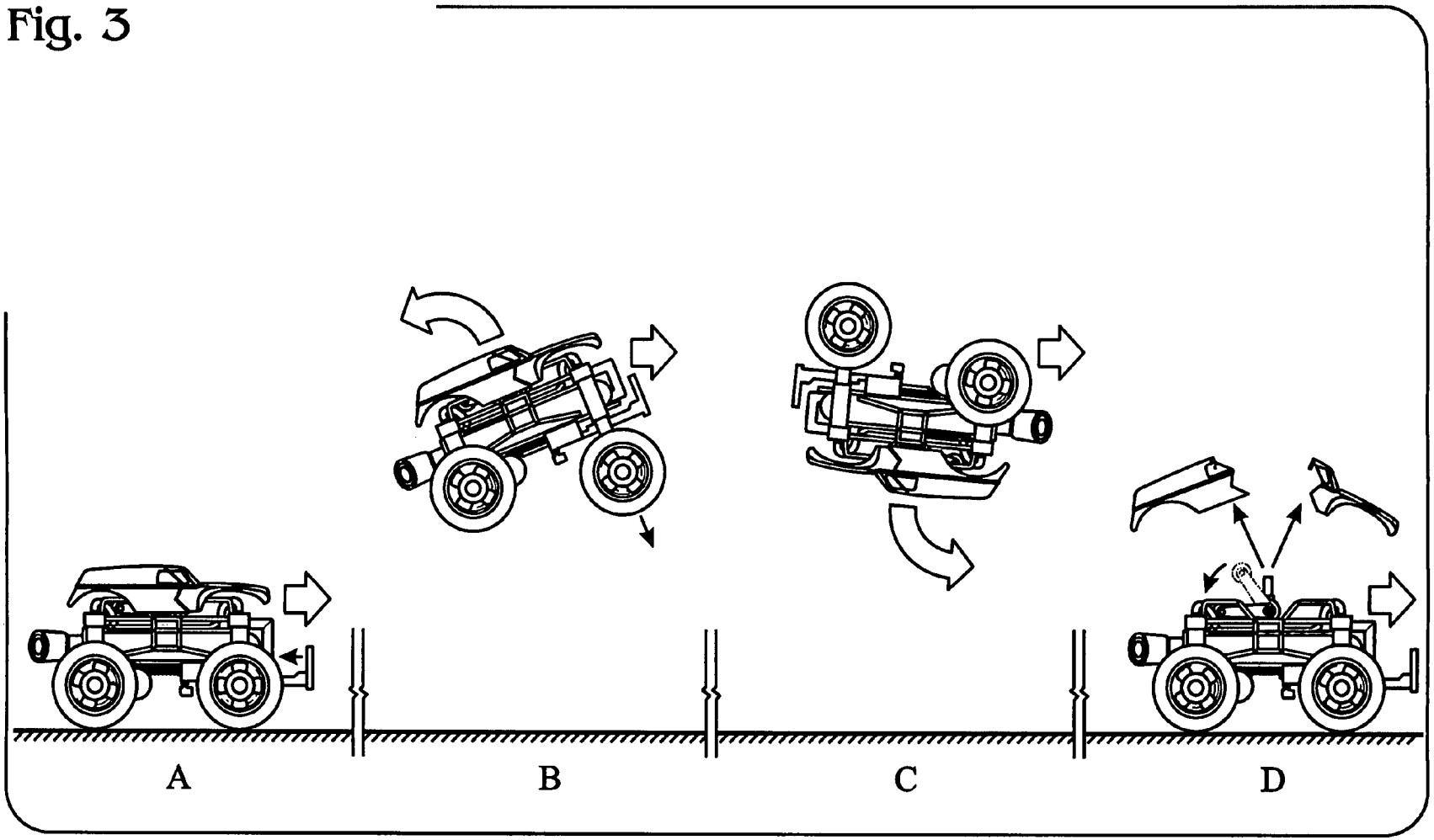
FIG. 3 shows the toy of FIG. 1 performing a flip action and a disassembly action.
Figure 4:
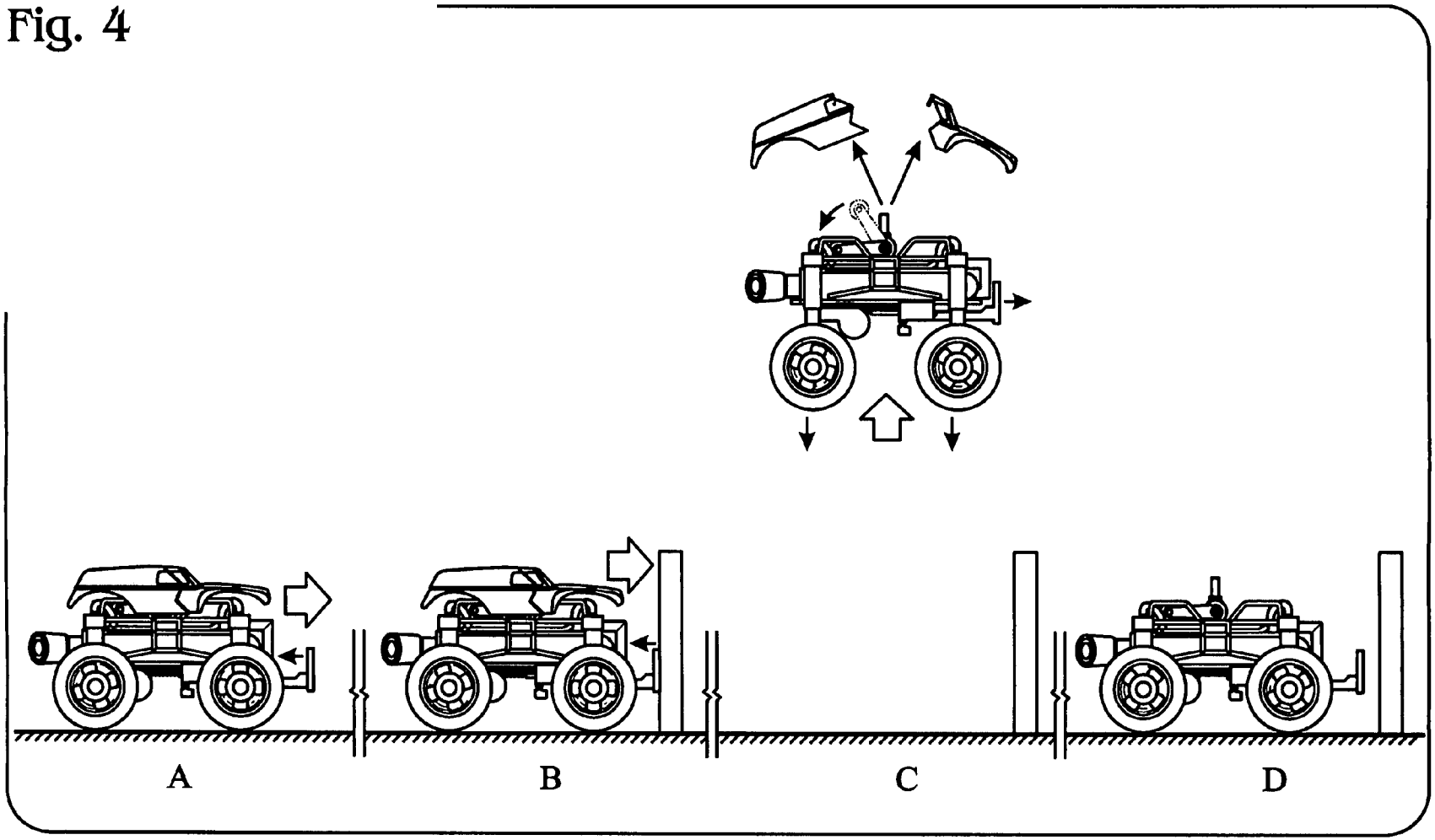
FIG. 4 shows the toy of FIG. 1 performing a jump action, responsive to colliding with an obstacle, and a disassembly action.

FIGS. 2-4 show various features of toy 10 in action. FIG. 2 shows an example sequence of the toy being set in motion, jumping, and simulating an explosion by ejecting the body shell from the vehicle, wherein the body shell can separate into plural pieces. As shown at A, the toy vehicle can be propelled forward by a user. During travel of the toy vehicle the front bumper can retract in proportion to the distance that the vehicle has traveled. As shown at B, when the front bumper retracts to past a threshold distance, pressure can be released from a pneumatic system of the vehicle causing actuation of a jumping assembly, in turn, causing the toy to jump off the ground. The upward lift of the toy causes an inertia arm to move in a downward direction which releases residual pressure from the pneumatic system through a blow-off port, causing the body shell to be ejected. As shown at C, the toy can begin to return to the ground after reaching the apex of the toy's jump. As shown at D, the toy can land the jump and continue in a forward direction.

While the present application describes using stored pressure to generate various effects, it should be appreciated in view of this disclosure that the term pressure, or pressurized, or variations thereof, may include negative pressure, or vacuum.

FIG. 3 shows and example sequence of the toy being set in motion, performing a rotational jump (flip) and simulating an explosion upon landing. In this sequence the toy vehicle can be configured with a flip lock engage which hinders actuation of the rear pistons. Because the front pistons fire freely, and the rear pistons do not, the toy rotates during the jump. As shown at A, the toy vehicle can be propelled forward by a user. As stated above, during travel of the toy vehicle the front bumper can retract, eventually triggering a release of pressure from the pneumatic system. As shown at B, the jump assembly can be actuated; however the rear pistons are locked so just the front pistons extend, initiating a backward rotational force causing the front end of the toy to rise. As shown at C, the rotational force created by the actuation of the jump assembly causes the vehicle to keep rotating while maintaining the inertia lever in an up position. As shown at D, the toy lands and the force of the landing moves the inertia arm to a downward position, causing a release of pressure through the blow-off port, which ejects the body shell.

FIG. 4 shows and example sequence of the toy being set in motion, colliding with an object, jumping, and simulating a mid-air explosion. As shown at A, the toy vehicle can be propelled forward by a user. As stated above, during travel of the toy vehicle the front bumper can retract, and if the vehicle travels far enough, a jumping mechanism will eventually be triggered. However, as shown at B, the vehicle collides with an object before the bumper can retract far enough to trigger a jump. Upon collision, bumper retraction is accelerated, and the jump maneuver occurs "prematurely" (e.g., before the jump maneuver would have occurred if the toy had not collided with another object). As shown at C, the upward lift of the toy causes an inertia arm to move in a downward direction, releasing residual pressure from the pneumatic system through a blow-off port, causing the body shell to be ejected. As shown at D, the toy can land the jump.

Although the toy vehicle may be propelled by a user, in some embodiments, the toy may include a self propulsion mechanism. For example, the toy may include an electric motor or even a remotely controlled electric motor. The toy's wheels may include a resistance tension mechanism which can be wound then released to impart motion to the vehicle, the pneumatic system can be used to propel the vehicle, or some other drive mechanism can be implemented.

A pneumatic system is provided as a nonlimiting example of a system for storing and releasing energy that can be used to cause the toy to jump, flip, and/or simulate an explosion. Other energy storing systems may utilize mechanically stored energy (e.g., a spring and/or a flywheel), electrically and/or magnetically stored energy, or some other form of stored energy.

While the simulated explosions are shown occurring at specific times during the aerial maneuvers of FIGS. 2-4, it should be understood that the toy can be configured to initiate the simulated explosion at different times.

Toy 10 includes components conventionally associated with a vehicle, although this is not necessarily required in order to implement several of the described features. In particular, toy 10 includes a chassis (also referred to as a body or base) generally referenced at 12 and a body shell (also referred to as a cover) generally referenced at 14. In the illustrated embodiment, body shell 14 can be removably mounted to chassis 12. Furthermore, chassis 12 may include upper frame 16 configured to support body shell 14 when secured to toy 10. Pistons 20 can be mounted to chassis 12, incorporated into upper frame 16, and/or otherwise operatively connected to the toy base. Front bumper 22 can be slidably mounted on the underside of chassis 12, and can protrude from the front of toy 10.

Toy 10 may include two front wheels 30 and two rear wheels 32 rotatably coupled to chassis 12. Specifically, front wheels 30 and rear wheels 32 can be linked via axles 34. In the illustrated embodiment, axles 34 can be configured to rotate freely within substructures disposed in the base of pistons 20. However, it should be appreciated that in some embodiments, the axles may be fixed in the substructures of the pistons and the wheels may be rotatably coupled to the axles. In some embodiments, each of the wheels may be mounted to the substructure of the pistons independently without the use of connecting axles.

Figure 10B:
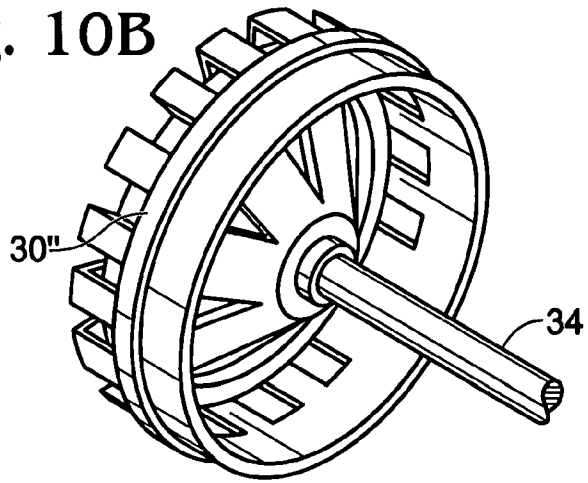
FIGS. 10A and 10B show wheels compatible with the vehicle of FIG. 1.
Figure 10A:
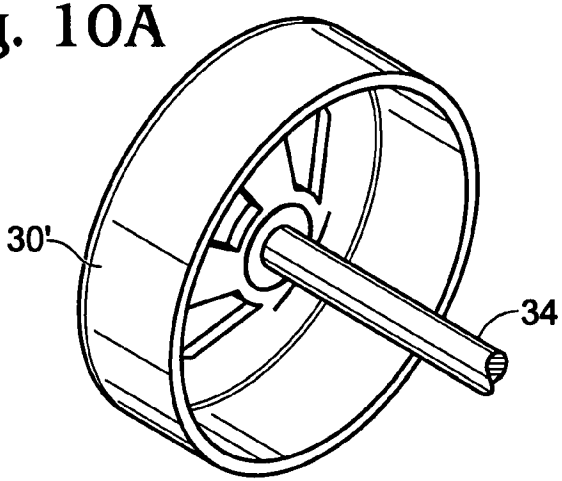

Additionally, some embodiments of the toy vehicle may include wheels differently configured based on a desired look or performance of the vehicle. For example, as shown in FIG. 10A, wheel 30' can be smooth in shape, in order to reduce wheel friction and improve performance of the toy as it rolls. Another example is shown in FIG. 10B. Wheel 30" may include a pattern of gaps in the wheel which may reduce the weight of the wheel. The weight reduction may improve the jumping ability of the toy. Furthermore, the toy vehicle may include any other wheel configuration that provides a desired look or performance.

Toy 10 may further include a pneumatic system generally referred to at 40. The pneumatic system can also be referred to as a pneumatic charger, or an air or gas delivery system. The pneumatic system can be used to deliver a pressurized gas charge to actuate one or more different components of the toy, such actuation of the various components causing the toy to execute one or more different actions (e.g., jump, flip, simulate explosion, etc.). The pneumatic system may comprise a plurality of different components for charging, releasing, and/or distributing pressurized gas, and/or using energy from the pressurized gas to actuate one or more toy components.

Figure 5:
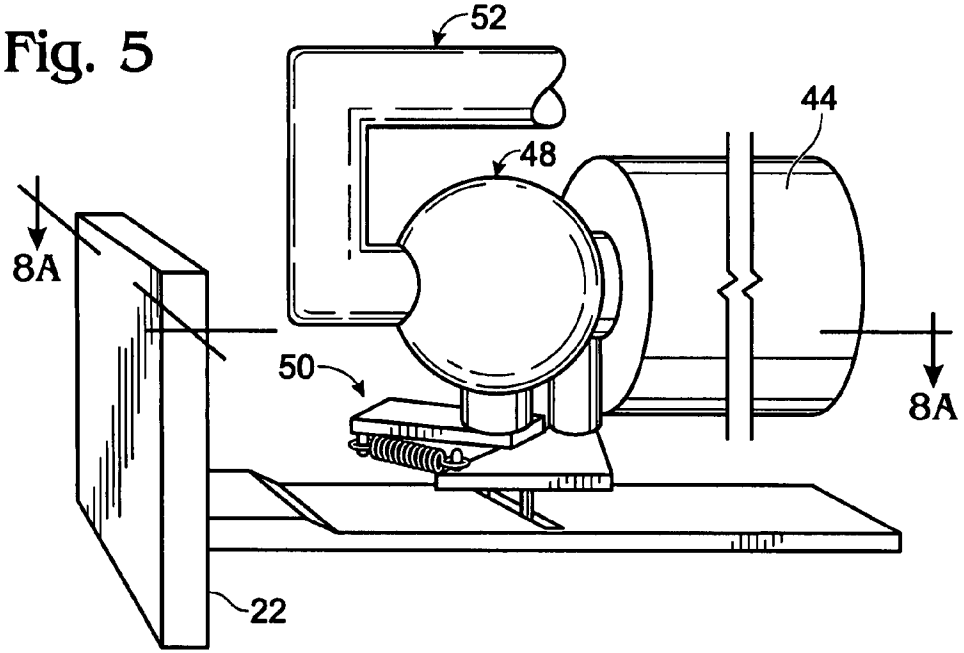
FIG. 5 shows an exemplary valve that can deliver a pneumatic charge to one or more pneumatically energized features.

In the illustrated embodiment, pneumatic system 40 can be charged by a charge mechanism 42 (e.g., a pump). Pneumatic pressure accumulated during the charging process can be stored in holding tank 44. Pneumatic pressure can be released from holding tank 44 via release valve 46. As shown in FIG. 5, pneumatic pressure can also be released via release valve 48. Release valve 48 can be opened and closed via release mechanism 50, which can be linked to front bumper 22. Actuating release valve 48 can enable air pressure to be delivered to pistons 20 via plumbing 52. The pistons can be constituent components of a jumping mechanism that can be configured to use energy from the pressurized gas to quickly extend the wheels, causing the toy to jump into the air.

Release valve 46 can be opened and closed via an inertia arm 60. Inertia arm 60 can also be referred to as an inertia lever or as an acceleration detector. The inertia arm can be configured to move responsive to a threshold acceleration (i.e., a sufficient change in velocity and/or a sufficient change in direction). The inertia arm can be configured so that some accelerations move the arm, while other accelerations do not move the arm. Actuating release valve 46 can enable pneumatic ejection of body shell 14 from chassis 12.

Although the illustrated embodiment includes a holding tank in the shape of a cylinder, it should be appreciated that the holding tank may take another shape, such as a sphere, hexahedron, or any other shape compatible with a particular toy.

The pneumatic system can be configured to accumulate air pressure within the holding tank via the charge mechanism. In the illustrated embodiment, charge mechanism 40 includes a pump rod 61 and a pump handle 62 affixed to the end of the pump rod. Charge mechanism 40 can be disposed in holding tank 44, and may extend out the rear of toy 10. In some embodiments, the charge mechanism may be positioned such that the pump rod extends out of the front of the toy, the top of the toy, the side of the toy, etc. The charge mechanism may be designed in accordance with the theme of a particular toy, such as by fashioning a pump handle to visually simulate the fender of an automobile.

The pneumatic system can be charged by pumping the charge mechanism. Pump handle 62 can be gripped and pump rod 61 can be pulled out of holding tank 44 until a one-way valve (not shown) contacts the end of the air chamber in holding tank 44, thus restricting pump rod 61 from extending further. The process of pulling the pump rod out of the holding tank (shown in dashed lines) causes air to be drawn into the holding tank through the one-way valve. Once air has been drawn into the holding tank, the pump rod can be pushed back into the holding tank, reducing the volume of air space due to the restriction of the one way valve, and increasing pressure in the pneumatic system. The pumping process can be repeated numerous times to produce a desired amount of air pressure in the holding tank. In other words, the holding tank can store air charge from one or more individual pumps. Therefore, the pressure of gas within the holding tank can be increased with additional pumping, and the increased pressure leads to increased energy available for performing more dramatic actions (e.g., jumping, flipping, simulating explosion, etc.).

In some embodiments, the holding tank may include a valve (e.g., a Schrader valve used in bicycle or car tire applications) configured to connect to a pump system independent from the toy. The independent system can be temporarily connected to the toy to pump air into the holding tank and charge the pneumatic system. The independent system can then be disconnected, leaving the pneumatic system with pressurized gas that can be used to actuate one or more different pneumatic devices on the toy. In some embodiments, the pneumatic system may include pre-pressurized cartridges, such as CO2 cartridges and/or a holding tank can be adapted to be charged from a pre-pressurized cartridge. Furthermore, in some embodiments, a toy may include multiple sources of pressurized gas to independently actuate various pneumatic components.

Figure 6:
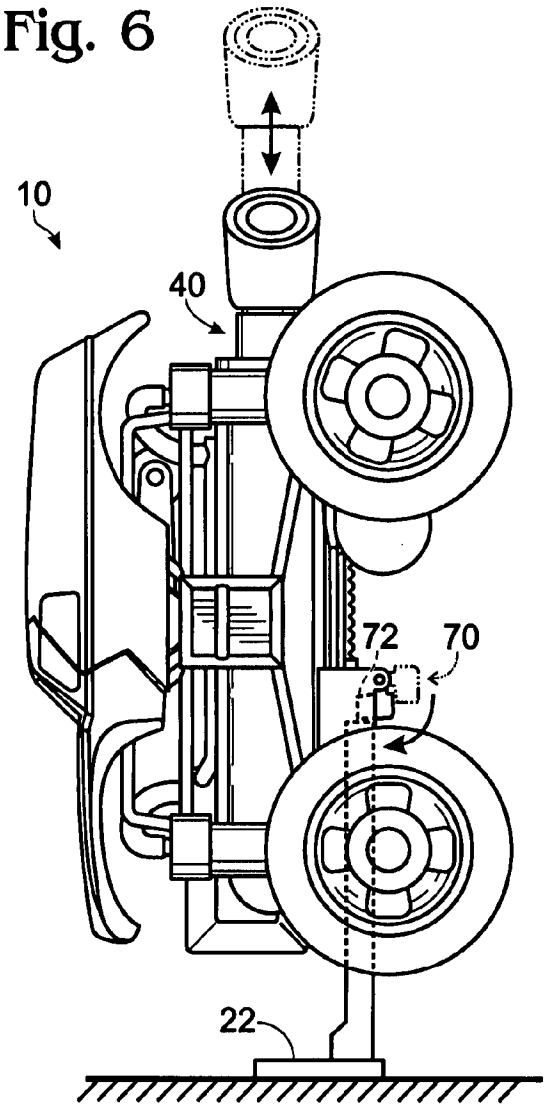
FIG. 6 shows the toy of FIG. 1 being pneumatically charged in a vertical configuration.

The toy can be placed in various positions to facilitate pumping the charge mechanism. A user can pump the pneumatic system while the toy is resting on the ground or a user can hold the toy off of the ground while pumping. When on the ground, the toy can be pumped in a variety of different orientations. As a nonlimiting example, FIG. 6 shows the toy situated substantially vertically with the front bumper of the toy resting flat on a surface. This position can provide stability and direct access to the charge mechanism while charging the pneumatic system. However, as discussed below, the front bumper can be configured to retract and open the pressure release valve.

During charging of the pneumatic system, the pumping process can cause force to be applied to the front bumper when the toy is in the above described charging position. Accordingly, toy 10 can include a lock 70 configured to prevent bumper 22 from retracting as a result of downward force applied during charging. Bumper lock 70 can be rotatably mounted to the bottom of chassis 12, such that when toy 10 is placed in a vertical charging position, bumper lock 70 can be configured to automatically rotate and fit into notch 72 in rack 74, which is operatively coupled to bumper 22. Bumper lock 70 can prevent bumper 22 from retracting and opening pressure release valve 48. The bumper lock can be configured to release from notch 72 when the toy is returned to a substantially horizontal orientation. In this way the toy can be placed in a stable position to charge the pneumatic system without releasing air pressure. In one example, gravity may facilitate motion of the bumper lock. For example, gravity may engage the bumper lock into the locked position.

It should be appreciated that in some embodiments, the bumper may be locked by a differently configured mechanism, such as an extendable locking rod, a hook, or any other suitable mechanism that prevents the bumper from retracting. Alternatively, in other embodiments, the toy may not include a release valve that is operatively linked to a bumper, and as such, there may be no need for a bumper lock.

Typically, after the pneumatic system is charged, the toy can be placed on the ground and pushed causing forward motion. The toy can be configured to perform an aerial maneuver after traveling a threshold distance or colliding with an obstacle before a threshold distance has been traveled. The aerial maneuver can be triggered by a release of pressure from the pneumatic system causing the jump assembly to actuate.

Figure 7A:
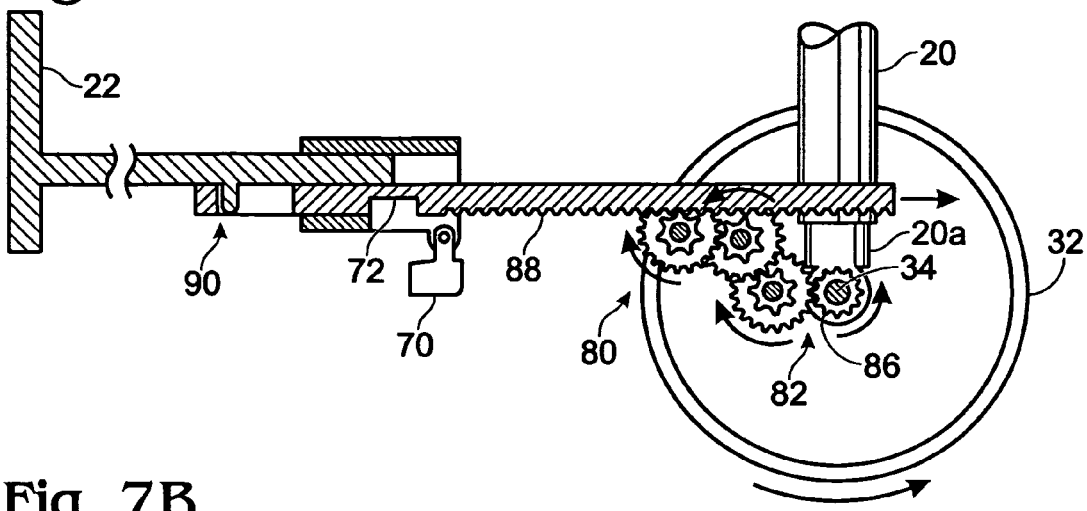
FIGS. 7A-7C show an exemplary triggering mechanism that can be used to trigger a jumping or flipping action in the toy of FIG. 1.
Figure 7B:
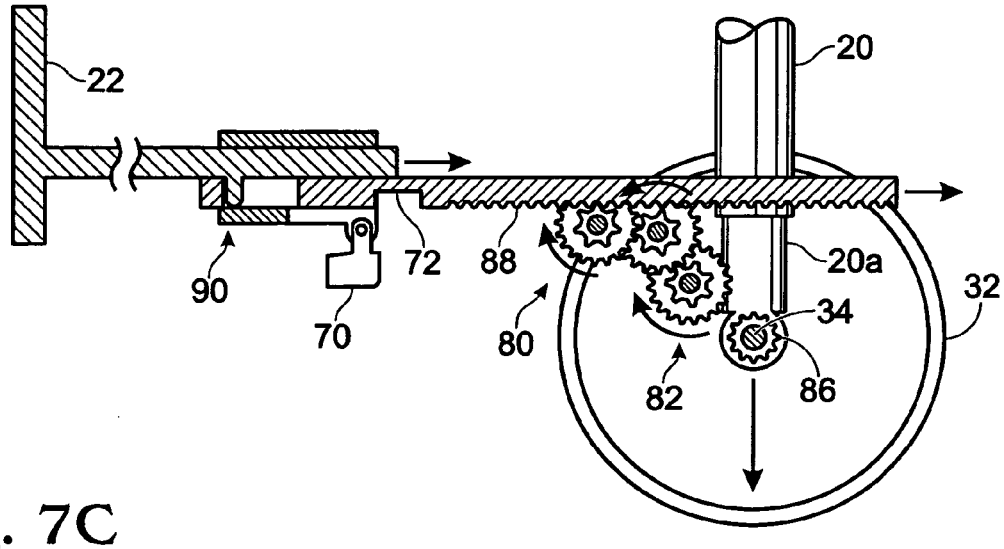
Figure 7C:
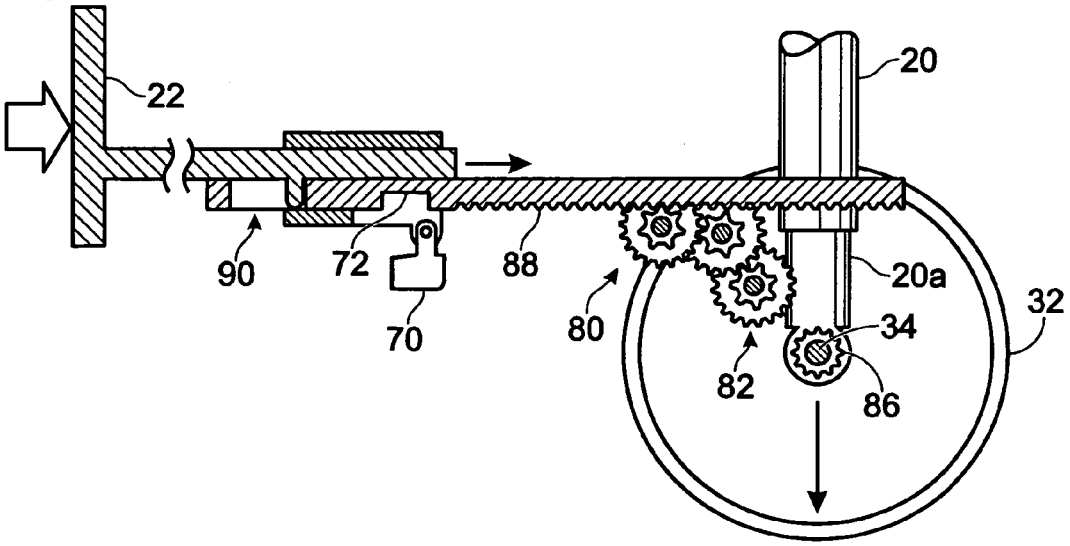

As shown in FIGS. 7A-7C, the release mechanism can include a motion translation system 80. The motion translation system can be configured to translate the rotational motion of the rear wheels into linear motion through a rack and pinion gear structure. The gear structure can be linked to the front bumper, which in turn, can be linked to the release mechanism (e.g., release valve 48). Thus, as the toy travels, the rotational motion of the wheels can cause the front bumper to retract, which in turn can cause the release mechanism to be triggered.

Motion translation system 80 includes gear assembly 82 operatively connected to rear axle 34 via a linking gear 86. The motion translation system further includes a rack gear 88 which links to front bumper 22 via a pin and slot assembly 90. Axle 34 can rotate, in turn, rotating gear assembly 82, thus engaging rack gear 88, causing rack gear 88 to move toward the rear of the toy. As rack gear 88 moves toward the rear of the toy, the rack gear pulls front bumper 22 causing front bumper 22 to retract. After the front bumper is retracted a threshold distance, the release mechanism is triggered, and the jumping mechanisms are actuated.

It should be appreciated that the axle can be mounted to the base of the pistons, which can be configured to compress under the weight of the toy when the toy is placed on the ground. In this manner, the axle may only engage the motion translation system when the toy is set on the ground or some other force is pressing the wheels toward the vehicle chassis.

Some embodiments of the toy may include alternative and/or additional motion transmission configurations configured to delay the release of pressure from the pneumatic system. For example, the gear structure may be configured such that the axle may have to reach a desired amount of revolutions per minute to trigger the release mechanism. Some configurations may include drive belts in addition to gears.

As discussed above, the toy can be configured to perform an aerial maneuver after colliding with an obstacle before a threshold distance has been traveled. As shown in FIGS. 7A-7C, pin and slot assembly 90 can be configured with the pin positioned forward in the slot so that as rack gear 88 moves toward the rear of toy 10, front bumper 22 can be retracted. However, the pin and slot assembly can allow the pin to slide within the slot. As shown in FIG. 7C, when front bumper 22 retracts as a result of a collision, the pin can slide to the rear of the slot providing the needed retraction distance to trigger the release mechanism. Furthermore, the movement of the pin within the slot enables the bumper to return to an unretracted position in a quick manner after triggering the release mechanism without needing the rack gear returned to a forward position. In this manner, the front bumper can be retracted and trigger the release mechanism as a result of a collision before the toy has traveled a threshold distance.

As shown in FIG. 5, pressure release valve 48 can be disposed near the front of holding tank 44. The pressure release valve can release pressure from holding tank 44 into plumbing 52 for delivery to the jumping mechanism, including pistons 20. Pressure release valve 48 can be opened and closed by release mechanism 50, which connects to front bumper 22. As discussed above, release mechanism 50 can be triggered by the retraction of front bumper 22, which in turn causes the opening and closing of release valve 48.

FIGS. 8A-8D show a sequence of front bumper 22 retracting to a point which triggers release mechanism 50, thus causing release valve 48 to open and close. In the illustrated embodiment, the release valve includes a ball valve. Release valve 48 includes inner valve 100 with openings **100*a* and 100*b* positioned on opposite sides of the inner valve. In the illustrated embodiment, the inner valve is shown as a hollow structure with openings 100*a* and 100*b*. The inner valve can alternatively be a solid structure with a passage or tunnel extending from opposing openings. Release valve 48 remains in a closed position when openings 100*a* and 100*b* are not aligned with openings in plumbing 52 and holding tank 44**.

Release valve 48 can be open by rotating inner valve 100 such that openings 100*a* and 100*b* are aligned with openings in plumbing 52 and holding tank 44.

Figure 8A:
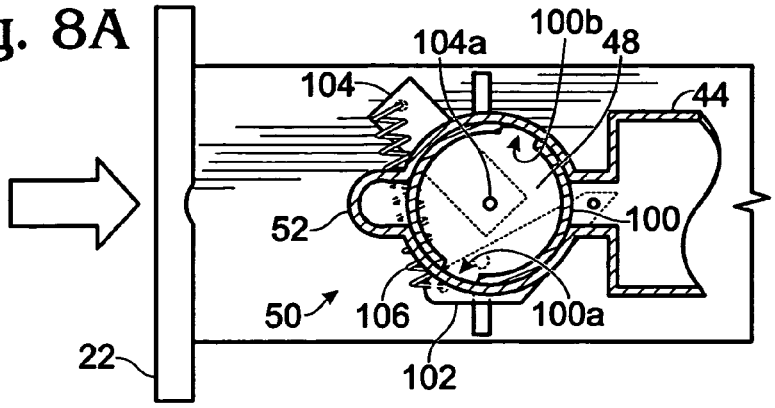
FIGS. 8A-8D somewhat schematically show a sequence of operation for the valve of FIG. 7.
Figure 8B:
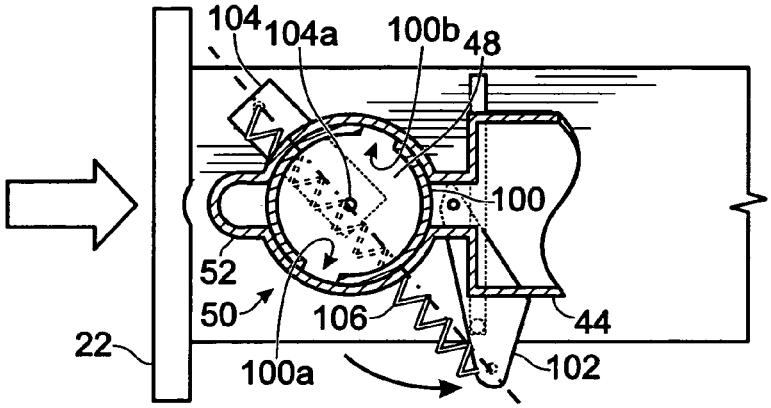

Release mechanism 50 includes a first lever 102 rotatably mounted to release valve 48 and a second lever 104 connected to inner valve 100. Lever 102 and lever 104 can be linked via spring 106. FIG. 8A shows lever 102 and lever 104 positioned such that spring 106 has relatively low tension and front bumper 22 is not retracted. Furthermore, release mechanism 50 can be configured so that as front bumper 22 retracts, lever 102 can swivel counter clockwise (as drawn in FIGS. 8A-8D) away from lever 104, thus increasing the tension in spring 106. Increased tension in spring 106, in turn, applies a counter clockwise torque to lever 104. However, when in the position shown in FIGS. 8A and 8B, the inner valve and lever 104 cannot rotate farther in the counter clockwise direction.

Figure 8C:
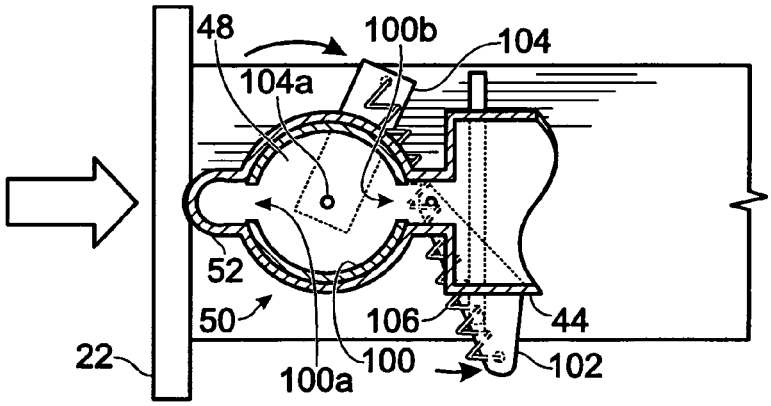

As shown in FIG. 8C, the front bumper can continue to retract and lever 102 can continue to rotate until the spring is aligned with a pivot 104*a* of lever 104. At this instant, spring 106 is not applying any torque to lever 104. However, as the bumper retracts farther, the spring begins to apply a clockwise torque to lever 104. The clockwise torque, which can be relatively substantial due to the potential energy stored in the stretched spring, can cause the valve to quickly open, momentarily aligning openings 100*a* and 100*b* with the holding tank and the plumbing to the jumping mechanism. Because the valve is opened quickly, a burst of energy in the form of pressurized gas can be delivered to the jumping mechanism, thus allowing the jumping mechanism to thrust the toy into an exciting jump.

Figure 8D:
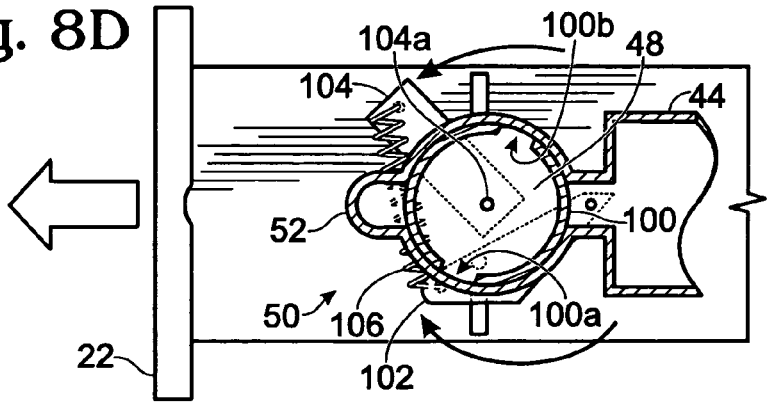

As shown in FIG. 8D, after release valve 48 is opened, tension in spring 106 causes levers 102 and 104 to rotate to an original position and front bumper 22 to return to an unretracted position. When closing, the vehicle may be in the air and/or the motion translation system may be disengaged from the bumper so that the valve can close without having to spin the rear wheels backwards. The release mechanism can be configured to open and close pressure release valve 48 quickly enough to allow for some pressurized gas to remain in holding tank 44, and such residual pressure can be used to activate another pneumatic device, such as the blow-off port controlled by release valve 46.

It should be appreciated that, in some embodiments, various other valve configurations may be used to release pressure in the pneumatic system, such as a check valve, plug valve, etc. In some embodiments, a toy may include a plurality of release valves with independent release mechanisms distributing pressure to various pneumatically actuated components. In some embodiments, the pressure release valves may have alternative mounting positions on the holding tank to cooperate with a desired air pressure distribution system configuration.

As discussed above, pressure released from the holding tank can be distributed through the air line to the jump assembly. In the illustrated embodiment, air line plumbing 52 can extend from pressure release valve 48 and can split into four lines separate lines, which individually provide fluid communication between the release valve and the pneumatic piston at each of the four wheels. The plumbing may be constructed from any material that is capable of handling the pressure tolerance of the system. Furthermore, the material can be lightweight to improve jump performance. Suitable materials can include rubber and plastic. In some embodiments, the air lines may be incorporated into the holding tank housing. In other embodiments, the pistons may directly connect to independent valves in the holding tank without using air lines for pressure distribution.

In the illustrated embodiment, the jump assembly can be configured with pistons situated on the chassis, such that each piston can be substantially aligned with each wheel. In some embodiments, the pistons may be positioned substantially vertically, which may be desirable for improved vertical lift. In other embodiments, the pistons may be positioned at an angle, such that the pistons can provide desired directional actuation. In some embodiments, the pistons may include internal shock absorbers which can be configured to reduce strain on the chassis during travel of the toy and provide an exciting bouncing action when landing from a jump.

As shown in FIG. 1, energy in the form of pressurized gas can be supplied to the jump assembly, including pistons 20, via plumbing 52. As shown in FIGS. 7A-7C, the pistons can include inner shafts 20*a* configured to extend outward from the base of the pistons in response to an applied air charge. Axle 34 can be connected to the inner shaft, thus linking the wheels to the pistons. This configuration enables pneumatic pressure to actuate pistons and cause the inner shafts to extend, which in turn, can extend the wheels away from the chassis. The extension can cause a downward force that creates vertical lift of the toy. In this manner, a pneumatically charged toy can perform various aerial maneuvers, including jumps and flips. The desired height of a jump maneuver can be regulated by the gas pressure in the pneumatic system.

Figure 9B:
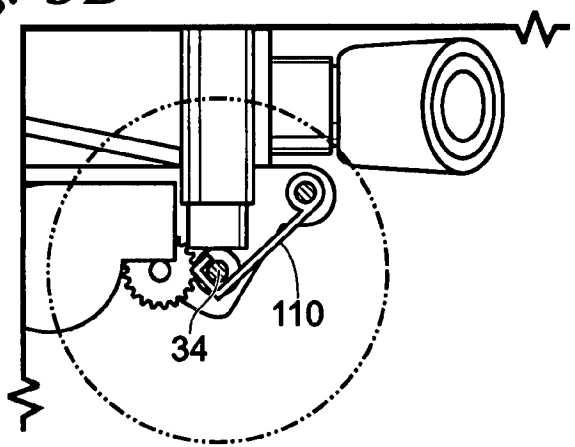
FIGS. 9A and 9B show an exemplary jump/flip selector for selectively locking extension of the rear wheels of the toy of FIG. 1.
Figure 9A:
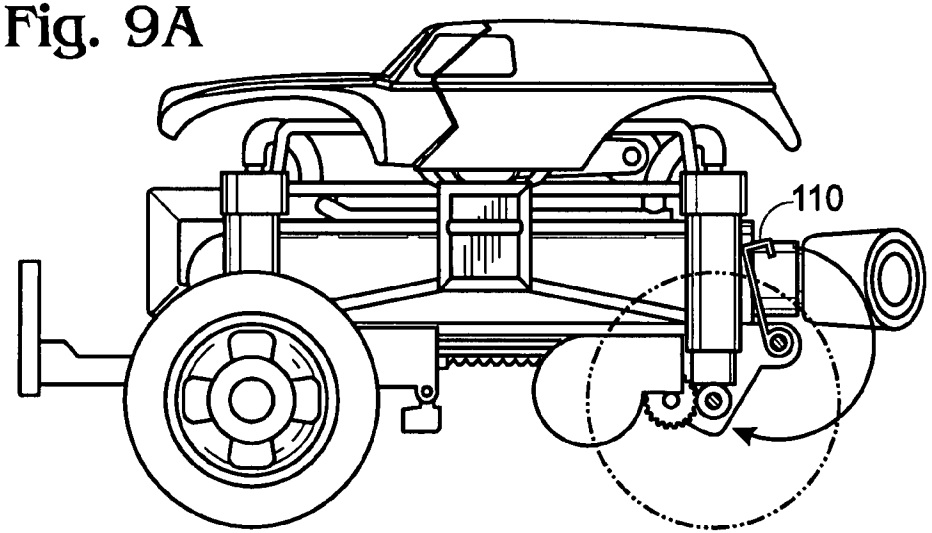

As illustrated in FIGS. 2 and 3, toy 10 may have multiple aerial maneuver configurations. A first configuration can cause the toy to perform a non-rotational jump maneuver, and a second configuration can cause the toy to perform a rotational jump or flip maneuver. The change in configurations can be controlled by a rear axle lock. FIGS. 9A and 9B show an exemplary rear axle lock 110. Rear axle lock 110 can be rotatably mounted to the chassis. As shown in FIG. 9A, rear axle lock 110 can be placed in an unlocked configuration which can enable toy 10 to perform a jump maneuver, wherein the toy can be set in motion and both the front and rear pistons can actuate at substantially the same time, creating upward force and resulting vertical lift. In other words, the toy jumps.

As shown in FIG. 9B, rear axle lock 110 can be rotated down and hooked over rear axle 34. This configuration can limit the ability of the rear set of pistons to extend. In some embodiments, this may direct a large amount of pneumatic power toward the front set of pistons. Since only the front pistons extend in the locked configuration, the vector of force applied to the toy is no longer substantially vertical, but rather directed both upward and behind the toy, and this causes the toy to rotate backwards as it lifts off the ground. The rotational force created by the actuation of the front pistons can be large enough to rotate the toy upward and backward, so that the toy can complete a back flip.

It should be appreciated that in some embodiments the toy may have other configurations enabling the toy to perform other aerial maneuvers, including front flips, barrel rolls, and directional jumps. Moreover, in some embodiments the toy may include a selection mechanism that controls the configuration, and the selector may be in the form of a switch, dial or other selector. In some embodiments, the toy may include a random selection mechanism which can switch the configuration of the toy to perform different aerial maneuvers.

In some embodiments, the toy may be configured to simulate an explosion by pneumatically ejecting the body shell from the toy. The toy may include a disassembly mechanism wherein the body shell can be coupled to a blow-off port which operatively connects to a pressure release valve. The pressure release valve may be opened and closed by an inertia arm (acceleration detector), wherein movement of the inertia arm based on a particularly directed acceleration may cause the opening of the pressure release valve, and thus eject the body shell from the toy.

As shown in FIG. 1, body shell 14 can include a plurality of body panels configured to disassemble as a result of ejection from toy 10. Each body panel can include a mating tab disposed on the underside of the body panel. Mating tabs 92 can be collectively sized and shaped to fit into ejection port (alternatively referred to as a blow-off port) 96, such that body shell 14 can be secured to toy 10 and may at least partially cover chassis 12. In the illustrated embodiment, the body panels and mating tabs 92 may be assembled and disassembled along edge 94. Edge 94 can enable body shell 14 to be properly aligned when secured to chassis 12.

As discussed above, the body shell can be ejected from the toy as a result of pressurized gas released from the pneumatic system. In the illustrated embodiment, body shell 14 can be secured to ejection port 96 via mating tabs 92. Furthermore, the ejection port can be connected to release valve 46, which is in fluid communication with holding tank 44. Release valve 46 can be opened and closed by actuation of inertia arm 60. It should be appreciated that release valve 46 can operate in substantially the same manner as release valve 48 (i.e. release valve 46 can be a ball valve). Opening of release valve 46 can cause pressurized gas to be released into blow off port 96 forcing the ejection of mating tabs 92 out of blow off port 96, which in turn causes the ejection of body shell 14 from toy 10. Ejection of the body shell may cause the body panels to disassemble into multiple pieces. It should be appreciated that in some embodiments, the body panels may further be connected by a hinge. Ejection of the hinged body shell may cause the body panels to separate, but remain connected. Furthermore, the body may include more than two different body panels.

In the illustrated embodiment, the inertia arm can be configured to change orientation in response to directional forces acting on the inertia arm. For example, when toy 10 performs a jumping maneuver, pistons 20 may actuate and create a directed force and upward acceleration of toy 10. This directed force and acceleration may act on inertia arm 60 causing it to move from a first orientation to a second orientation, which may cause release valve 46 to open and eject body shell 14 from the toy 10. It should be appreciated that the inertia arm may also change orientation in response to a change in directed force. For example, if toy 10 collides with an object stopping forward motion of toy 10, the force applied to stop toy 10 can cause a change in orientation of inertia arm 60.

A plurality of pneumatic components can be energized by pressurized gas to perform different actions on a toy. For example, the illustrated embodiment includes a first set of pneumatically energized components which cause the toy to jump, and a second pneumatically energized component configured to eject the body shell from the toy.

Furthermore, in some embodiments, pneumatic components on the toy may be energized by a single source of pressurized gas. In some embodiments, the toy may include multiple sources of pressurized gas to energize different pneumatic components and systems.

The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A toy vehicle, comprising:

a base;

a plurality of wheels spinably connected to the base;

a pneumatic piston operatively connected to at least one of the wheels;

a plurality of body pieces at least partially covering the base;

a pneumatic disassembly mechanism operatively connected to at least some of the plurality of body pieces; and a pneumatic system configured to deliver pressurized gas to the pneumatic piston to cause at least the base to jump by extending the at least one wheel away from the base, and to deliver pressurized gas to the pneumatic disassembly mechanism to separate at least some of the plurality of body pieces from the base.

2. The toy vehicle of claim 1, wherein each of the plurality of wheels is operatively connected to a pneumatic piston that uses pressurized gas delivered from the pneumatic system to extend each of the plurality of wheels, thereby causing the body to jump.

3. The toy vehicle of claim 1, wherein the pneumatic disassembly mechanism includes an ejection port configured to discharge pressurized gas that blows at least some of the plurality of body pieces away from the base.

4. The toy vehicle of claim 1, wherein the pressurized gas delivered to the pneumatic piston and the pressurized gas delivered to the pneumatic disassembly mechanism are from a common source.

5. A toy, comprising:

a base;

a plurality of pieces at least partially covering the base;

a jumping mechanism operatively connected to the base and configured to cause at least the base to jump responsive to a first triggering event; and a disassembly mechanism operatively connected to at least some of the plurality of pieces and configured to cause at least some of the plurality of pieces to separate from the base responsive to a second triggering event, wherein the jumping mechanism and the disassembly mechanism use energy from a common source to cause the base to jump and to cause at least some of the pieces to separate from the base.

6. The toy of claim 5, wherein the common source is a reservoir holding pressurized gas.

7. The toy of claim 5, wherein the first triggering event includes the toy traveling a threshold distance.

8. The toy of claim 5, wherein the first triggering event includes a collision with another object.

9. The toy of claim 5, wherein the second triggering event includes toy acceleration exceeding a threshold acceleration.

10. The toy of claim 9, wherein the disassembly mechanism includes an inertia lever for detecting if toy acceleration exceeds a threshold acceleration.

11. The toy of claim 5, wherein the jumping mechanism includes at least one pneumatic piston.

12. The toy of claim 5, wherein the disassembly mechanism includes at least one pneumatic ejection port.

13. A pneumatic toy, comprising:

a pneumatic tank for storing pressurized gas;

a first pneumatically energized system in fluid communication with the pneumatic tank and configured to use the pressurized gas to effectuate a first action, the first action being the toy jumping; and a second pneumatically energized system in fluid communication with the pneumatic tank and configured to use the pressurized gas to effectuate a second action, different than the first action, the second action being the separation of at least one part from the toy.

14. The pneumatic toy of claim 13, further comprising:

a first trigger in operative communication with the first pneumatically energized system and configured to initiate the first action responsive to a first triggering event; and a second trigger in operative communication with the second pneumatically energized system and configured to initiate the second action responsive to a second triggering event, different than the first triggering event.

15. The toy of claim 14, wherein the first triggering event includes the toy traveling a threshold distance.

16. The toy of claim 14, wherein the first triggering event includes a collision with another object.

17. The toy of claim 14, wherein the second triggering event includes toy acceleration exceeding a threshold acceleration.

18. The toy of claim 17, wherein the second trigger includes an inertia lever for opening a valve if toy acceleration exceeds a threshold acceleration.

19. A toy, comprising:

a pneumatic port defining an air passage; and a plurality of body panels collectively forming a toy body, wherein at least two of the body panels include mating tab portions that are collectively sized and shaped to fit into the pneumatic port, and at least two of the body panels are operatively connected via a hinge; wherein air forced through the pneumatic port causes the plurality of body panels to separate from the pneumatic port and causes the hinge to pivot.

20. The toy of claim 19, wherein air forced through the pneumatic port further causes the plurality of body panels to separate from one another.

21. A toy vehicle, comprising:

a core including a pneumatic system having a tank for storing pressurized gas and a pump for pressurizing gas within the tank;

a body releasably covering at least some of the core;

a plurality of pneumatic pistons operatively connecting a plurality of spinable wheels to the core, each pneumatic piston being configured to extend one of the plurality of wheels away from the core responsive to receiving a charge of the pressurized gas;

a jump selector having at least a first state and a second state, wherein the toy does a rotating jump when the plurality of pneumatic pistons cause the toy to jump and the jump selector is in the first state, and wherein the toy does a less-rotating jump when the plurality of pneumatic pistons cause the toy to jump and the jump selector is in the second state; and a pneumatic disassembly mechanism configured to separate the body from the core responsive to receiving a charge of the pressurized gas.

22. The toy vehicle of claim 21, wherein the jump selector limits extension of at least one of the plurality of wheels.

* * * * *

UNITED STATES PATENT AND TRADEMARK OFFICE

CERTIFICATE OF CORRECTION

PATENT NO. : 7,654,879 B2
APPLICATION NO. : 11/418682
DATED : February 2, 2010
INVENTOR(S) : Steve Dunham It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 436 days.

Signed and Sealed this

Twenty-third Day of November, 2010

David J. Kappos

David J. Kappos
*Director of the United States Patent and Trademark Office*